US010088204B2

(12) United States Patent
Eibner et al.

(10) Patent No.: US 10,088,204 B2
(45) Date of Patent: Oct. 2, 2018

(54) CONDENSER

(71) Applicant: MAHLE INTERNATIONAL GMBH, Stuttgart (DE)

(72) Inventors: Helmut Eibner, Stuttgart (DE); Klaus Förster, Ludwigsburg (DE); Uwe Förster, Erdmannhausen (DE); Andreas Dränkow, Heimsheim (DE); Martin Kaspar, Fellbach (DE); Christoph Kästle, Ulm (DE); Thomas Mager, Ludwigsburg (DE); Herbert Hofmann, Stuttgart (DE); Markus Pflieger, Stuttgart (DE); Holger Striege, Möglingen (DE); Christoph Walter, Stuttgart (DE); David Mayor Tonda, Stuttgart (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 172 days.

(21) Appl. No.: 14/890,640

(22) PCT Filed: May 15, 2014

(86) PCT No.: PCT/EP2014/060024
§ 371 (c)(1),
(2) Date: Nov. 12, 2015

(87) PCT Pub. No.: WO2014/184323
PCT Pub. Date: Nov. 20, 2014

(65) Prior Publication Data

US 2016/0091229 A1 Mar. 31, 2016

(30) Foreign Application Priority Data

May 16, 2013 (DE) ..... 10 2013 209 157

(51) Int. Cl.

| | |
|---|---|
| ***F25B 39/04*** | (2006.01) |
| ***F25B 40/02*** | (2006.01) |
| ***F28D 9/00*** | (2006.01) |
| ***F28D 21/00*** | (2006.01) |
| ***F25B 39/00*** | (2006.01) |

(52) U.S. Cl.
CPC ..... *F25B 39/04* (2013.01); *F25B 39/00* (2013.01); *F25B 40/02* (2013.01); *F28D 9/005* (2013.01);
(Continued)

(58) Field of Classification Search
CPC ..... F25B 39/00; F25B 39/04; F25B 40/02; F25B 2339/043; F25B 2339/044;
(Continued)

(56) References Cited

U.S. PATENT DOCUMENTS 6,119,766 A * 9/2000 Blomgren ..... F28D 9/005 165/167
2009/0071189 A1 3/2009 Martins et al.
(Continued)

FOREIGN PATENT DOCUMENTS

CN 102639953 A 8/2012
DE 10 2010 026 507 A1 1/2012
(Continued)

OTHER PUBLICATIONS

International Search Report, PCT/EP2014/060024, dated Jul. 2, 2014, 2 pgs.
(Continued)

*Primary Examiner* — Len Tran
*Assistant Examiner* — Hans Weiland
(74) *Attorney, Agent, or Firm* — Paul D. Strain, Esq.; Strain & Strain PLLC

(57) ABSTRACT

The invention relates to a condenser of stacked-plate design, having a first flow duct for a refrigerant and having a second flow duct for a coolant.

19 Claims, 6 Drawing Sheets

(52) U.S. Cl.
CPC . *F25B 2339/044* (2013.01); *F25B 2339/0444* (2013.01); *F28D 2021/007* (2013.01); *F28D 2021/0073* (2013.01); *F28D 2021/0084* (2013.01)

(58) Field of Classification Search
CPC ..... F25B 2339/0444; F25B 2339/0446; F25B 2339/047; F28D 9/005; F28D 2021/007; F28D 2021/0073; F28D 2021/0084
See application file for complete search history.

(56) References Cited

U.S. PATENT DOCUMENTS

2012/0222846 A1* 9/2012 Kadle ..... F28D 9/005 165/166
2012/0234523 A1 9/2012 Jouanny et al.
2013/0146265 A1* 6/2013 Kim ..... F28D 9/005 165/166

FOREIGN PATENT DOCUMENTS

| | | | |
|---|---|---|---|
| DE | 10 2011 078 136 | A1 | 12/2012 |
| EP | 2 476 975 | A2 | 7/2012 |
| EP | 2 711 657 | A1 | 3/2014 |
| JP | 2002-310592 | A | 10/2002 |
| JP | 2011-247579 | A | 12/2011 |
| WO | WO 2009/068547 | A1 | 6/2009 |

OTHER PUBLICATIONS

German Search Report, Appl. No. 10 2013 209 157.5, dated Dec. 18, 2013, 5 pgs.

* cited by examiner

CONDENSER

CROSS-REFERENCE TO RELATED PATENT APPLICATIONS

This application is a National Stage of International Application No. PCT/EP2014/060024, filed May 15, 2014, which is based upon and claims the benefit of priority from prior German Patent Application No. 10 2013 209 157.5, filed May 16, 2013, the entire contents of all of which are incorporated herein by reference in their entirety.

TECHNICAL FIELD

The invention relates to a condenser of stacked plate design, having a first flow channel for a refrigerant and having a second flow channel for a coolant, in accordance with claim 1.

PRIOR ART

Condensers are used in refrigerant circuits of air-conditioning systems for motor vehicles in order to cool the refrigerant to the condensation temperature and to condense the refrigerant. Condensers often have a receiver in which a refrigerant volume is held. Volume fluctuations in the refrigerant circuit can be compensated for by said refrigerant volume.

Additional means for drying and/or filtering the refrigerant are often provided in the receives. Normally, the receives is arranged on the condenser. The refrigerant which has already flowed through part of the condenser flows through the receiver. After flowing through the receiver, the refrigerant, is returned to the condenser and is subcooled to below the condensation temperature in a subcooling section.

In the case of conventional condensers of fin and tube construction, the refrigerant is, for this purpose, passed out of the condenser out of one of the collecting tubes arranged at the side of the tube-fin block and passed into the receiver.

In the case of condensers which are of stacked plate design, it can be provided that the receiver is added to the plate stack as an additional layer in the form of plate elements.

In addition, the prior art discloses solutions in which the refrigerant is passed out of the condenser of stacked plate design via a special distributor plate and is fed to an external receiver. After flowing through the receiver, the refrigerant is returned again to the condenser.

The disadvantage with the solutions from the prior art is, in particular, that integrating condensers, receivers and subcoolers is associated with a high outlay. The prior art condensers are distinguished by a complex design and an increased outlay on manufacturing. This results in additional costs making the use of such condensers unattractive.

SUMMARY OF THE INVENTION, OBJECT, SOLUTION, ADVANTAGES

It is therefore the object of the present invention to provide a condenser which is suitable for condensing a refrigerant, for storing the latter and furthermore for subcooling the latter, wherein the condenser is characterized by a simple construction and a compact design and can be produced at low cost.

The object of the present invention is achieved by a condenser of stacked plate design having the features of claim 1.

An exemplary embodiment of the invention relates to a condenser of stacked plate design, having a first flow channel for a refrigerant and having a second flow channel for a coolant, wherein a plurality of plate elements is provided, which form channels adjacent to each other between the plate elements when the plate elements are stacked on top of each other, wherein a first number of the channels is associated with the first flow channel and a second number of the channels is associated with the second flow channel, wherein the first flow channel has a first region for desuperheating and condensing the vaporous refrigerant and a second region for subcooling the condensed refrigerant having a receiver for storing a refrigerant, wherein a refrigerant transfer from the first region to the second region leads through the receiver, wherein the receiver is in fluid communication with the first region by means of a first connection element, which forms a first fluid connection of the receiver, wherein the receiver is in fluid communication with the second region by means of second connection element, which forms second fluid connection of the receiver, wherein the first connection element and/or the second connection element are/is formed by a tube which passes through a number of plate elements by means of openings in the plate elements.

The construction of a condenser of stacked plate design can be implemented in a particularly simple and low-cost manner. In general, a multiplicity of identical plate elements can be used for the construction. Only the outer boundary plates of the plate stack or plate elements within the plate stack, which perform additional functions, such as blocking or diverting a flow channel, have a different configuration.

The division of the flow channel carrying the refrigerant into first region, which is used for desuperheating and condensing the refrigerant in the vaporous phase thereof, and into a second region, which is used for subcooling the condensed refrigerant, has the effect that fully subcooled refrigerant is always present at the end of the condenser.

In order to keep the refrigerant volume in the refrigerant circuit constant and to additionally dry and/or filter the refrigerant, it is advantageous to integrate a receiver into the refrigerant circuit. The latter is advantageously integrated into the refrigerant flow channel at a point at which the refrigerant has already completely condensed, but is not yet subcooled.

By means of the use of a tube to connect a receiver to the first flow channel, the condenser can be formed by a plate stack which predominantly consists of identical plate elements, despite arrangement of the receiver outside the condenser.

The tube is passed here through a series of plate elements situated adjacent to one another. Here, the tube is preferably passed through the openings in the plate elements. The tube is inserted here into the plate stack until said tube opens into one of the channels which is associated with the desired flow channel. In the present case, this is a channel of the first flow channel.

It is also preferable if the first connection element is designed as a tube and the tube leads from the second region through the first region to a fluid connection of the receiver, wherein the tube is in fluid communication with the second region of the first flow channel and with the receiver.

In order to integrate the receiver at the most favorable point, for the overall working process of the condenser, it is particularly advantageous if the receiver is connected directly to the desuperheating region and to the condensing region. This first region of the condenser is ahead of the second region, in which the subcooling takes place, when viewed in the flow direction of the refrigerant.

In order to pass all of the refrigerant from the second region of the first flow channel into the receiver or out of the latter, the tube is dimensioned in such a way that it passes through all of the plate elements of the first region and opens into a channel of the second region. In this way, the refrigerant is carried directly into the receiver or out of the receiver, bypassing the first region.

It is furthermore preferable if at least one of the tubes has a tapered portion, and/or a step and/or an at least partially encircling flange and/or an expanded portion via which said tube is supportable on one of the plate elements and is fixable in the condenser.

A flange can be produced here, for example, by means of compression; alternatively, the flange can also be designed as a separate component which is added onto a tube. The flange is used here to provide support in relation to one or more of the plate elements and contributes to better sealing.

Alternatively, a tapered portion with which the tube is insertable into an opening can be provided on one of the tubes. A tapered portion can be produced here, for example, by pressing or by machining. An expansion can be produced, for example, by hydroforming.

By means of one or more of said elements, a tube can be supported in a particularly advantageous manner on the plate elements of the condenser and fixed in the condenser. The above-described elements can be used here in particular as a stop.

It is also expedient if at least one of the plate elements is designed as a separating plate and/or one of the plate elements is designed as a deflecting plate.

A separating plate is essentially distinguished here from a deflecting plate by the fact that the openings in the respective plate element, via which openings the channel formed between the plates is in fluid communication, with an adjacent channel, are provided at different points. Otherwise, the two plate elements can have a very similar or identical construction. The different arrangement of the openings can be achieved here, for example, by placing the plate elements on one another in a laterally reversed manner.

A deflecting plate is distinguished here in particular by the fact that it does not provide an opening opposite the opening in the adjacent separating plate, which opening permits a fluid to flow into one of the flow channels, and therefore deflects or diverts the inflowing fluid within the channel.

Furthermore, it is advantageous if the tube is supported in the condenser on a deflecting plate.

By supporting the tube on a deflecting plate, the movement of the tube into the condenser, in particular during the installation operation, is already limited by the tube striking against the deflecting plate. This facilitates the installation and increases the stability of the condenser.

Furthermore, it is preferable if the tube has radial and/or axial openings.

If the tube bears against a deflecting plate, it is particularly advantageous if radial openings are provided, through which a fluid can flow out of the tube or into the tube. The radial openings can be formed, for example, by means of bores, slots or recesses in some other form. The openings are advantageously arranged on one of the end regions of the tube in order to produce a defined flow from the tube into one or more of the flow channels.

It is also advantageous if the tube is supported on one of the outer plate elements of the second region.

An outer plate element is intended here to mean particular one of the plate elements which seals off the second region, which is formed from a stack of a plurality of plate elements, from an adjacent region.

According to a particularly favorable development of the invention, it can be provided that a second tube is provided at the fluid inlet, and/or at the fluid outlet of the first flow channel, said second tube being in fluid communication with another channel, of the first flow channel.

In addition, it is expedient if a third tube is provided at the fluid inlet and/or at the fluid outlet of the second flow channel, said third tube being in fluid communication with another channel of the second flow channel.

By means of the connection of the fluid inlet or the fluid outlet of the respective first flow channel or of the second flow channel, the fluid flowing through the corresponding flow channel can be guided passed adjacent channels and can therefore be conducted into or discharged from a predetermined channel. This results in a configuration of the condenser that has both the fluid inlet and the fluid outlet of the respective flow channel at a common end region.

It is advantageous here if the other channel is one of the last channels of the respective flow channel, which channel is substantially opposite the insertion side of the tube in the plate stack.

The effect which can be achieved by this is that the refrigerants or the coolant flows through the entire condenser or through the flow path provided within the condenser before flowing back again through the tube through the entire condenser and also flowing out at the same end region of the plate stack, at which said refrigerant or coolant flowed into the plate stack.

It is furthermore preferable if the plate elements have openings with or without a rim.

If plate elements which are directly adjacent to one another have mutually opposite openings with rims, the fluid flows directly into the next but one channel of the plate stack, since a flow passage is formed by the two opposite rims.

The effect achieved by this is that an alternation between channels which are included in the first flow channel and channels which are included in the second flow channel is achieved in the plate stack. A uniform distribution can be produced here, and therefore a channel of the first flow channel is always followed by a channel of the second flow channel. Distributions deviating therefrom can also be produced with this method.

It is also advantageous if the at least one tube is passed through the openings in the plate elements and is brazed to at least a subset of the plate elements, in particular to the rims.

By inserting the tubes into the openings and brazing the tubes to the plate elements and in particular to the rims, a compact constructional unit distinguished by high strength is achieved. In an advantageous manner, the tubes can be brazed here to the plate stack in a single working step. This is particularly advantageous in particular in respect of an optimized production process.

Furthermore, it can be particularly advantageous if at least one of the tubes has an at least partially encircling flange via which said tube is supportable on one of the plate elements.

A flange can be produced here, for example, by means of compression; alternatively, the flange can also be designed as a separate component which is added onto a tube. The flange is used here to provide support in relation to one or more of the plate elements and contributes to better sealing.

A preferred exemplary embodiment is characterized in that at least one of the tubes is beveled at one end region or at both end regions.

A beveled tube is advantageously produced by a section through the tube along a plane which is at a predeterminable angle to the center axis of the tube. This results in the tube having an arrow shape. The effect which can be achieved by such a beveled tube is that the tube can be supported within the condenser with the resulting point on a stop surface, in particular on a plate element, and at the same time a fluid can flow into the tube.

It is also preferable if at least one of the tubes has a flexible region, wherein the tube is compressible and/or extendable in the axial direction by means of the flexible region.

A change in length of the condenser can be compensated for by a flexible region which permits compression or extension to be compensated for. In particular during the brazing process, "settling" occurs in the condenser. Said settling is caused by movement of the plate elements relative one another during the brazing operation flexible region in the tubes can therefore prevent stresses from occurring within the condenser. The flexible region here can absorb compressions as a result of setting operations and also extensions as a result of other mechanical or thermal influences.

In a particularly favorable refinement of the invention, it is also provided that the flexible region is formed by a concertina-like configuration of the tube.

A concertina-like configuration of the flexible region makes it possible to absorb compressions and/or extensions in a particularly simple manner. The flexible region is formed here by folded material regions which are moved toward one another in the event of compression and are moved away from one another in the event of an extension. The tube can be configured here in such a manner that a compression or extension can be absorbed once or repeatedly.

In an alternative refinement of the invention, it can be provided that the flexible region is formed from an elastic material, such as, for example, plastic or rubber, wherein a compression or extension of the tube in the axial direction and/or in the radial direction is reversible.

Forming the flexible point, from a material, such as, for example, plastic or rubber, is advantageous in particular in order to permit a reversible deformation of the tube. Plastics and rubber have a substantially higher shape-changing capacity than metallic materials.

Furthermore, it is preferable if at least one of the tubes is formed from a plurality of tube sections, wherein the tube sections are connected in a fluid-tight manner to one another.

A tube which is formed from a plurality of tube sections can provide compensation of length in a particularly advantageous manner. This can be achieved by the tube sections executing a movement relative to one another. The tube sections here are advantageously inserted one inside another, wherein one tube section has a smaller outside diameter than the inside diameter of the other tube section in each case. A fluid-tight connection of the respective tube sections to one another is particularly advantageous in order not to produce any inadvertent mixing of the fluid flows within the condenser.

Such a tube construction is particularly suitable in order to compensate for changes in length which arise during the brazing of the plate stack. In particular due to the action of heat, "settling processes" may occur during the brazing, causing the individual plate elements to at least partially slide one inside another. Said change in length can advantageously be compensated for here by a multi-part tube.

After the brazing operation is finished, the tube sections are then likewise advantageously brazed to one another, and therefore a movement of the sections relative to one another is prevented. The fluid tightness of the tube can thereby also be produced in a simple manner.

It can also be expedient if a first tube section tapers in a funnel-shaped manner in the axial direction and the second tube section widens in a funnel-shaped manner in the axial direction, wherein the two tube sections are inserted one inside the other in such a manner that the relative movement between the second tube section and the first tube section is limited by the widening region striking against the tapering region.

By means of a funnel-shaped configuration of the tube sections, the movement of the tube sections relative to one another can be made possible and at the same time a stop which limits the relative movement can be produced. For this purpose, the first tube section advantageously has an inside diameter which is of a size sufficient so that the second tube section can be moved within the first tube section.

Furthermore, it is expedient if the tube is accommodated in a connection element and is connected in a fluid-tight manner thereto.

A connection, element can be formed, for example, by means of a flange on the condenser or on the receiver.

Furthermore, it is advantageous if the second region has a plurality of flow routes through which the refrigerant can flow, wherein the flow routes are each formed by individual channels of the first flow channel and/or are formed by subregions of individual channels of the first flow channel.

A plurality of flow routes for guiding the refrigerant in the second region of the first flow channel is advantageous in order to improve the heat transfer between the refrigerant and the coolant. The flow routes can be formed here by channels which are formed between mutually adjacent plate elements, or by subregions of said channels. For this purpose, for example, separating means can be provided in the channels, as a result of which the channels are divided into subregions. Depending on fluid connection of the channels or of the flow routes to one another, the refrigerant can flow through the individual flow routes in parallel or in series. Furthermore, a flow of the refrigerant can be achieved in a co-current flow and/or in countercurrent flow with the coolant.

It is also preferable if the second region has plurality of channels, wherein at least individual channels of the second region are in thermal contact with the second flow channel, wherein the coolant and the refrigerant are flowable in co-current flow and/or in countercurrent flow to each other through the channels of the second region and through the second flow channel.

A flow of refrigerant and coolant in a plurality of mutually adjacent channels is particularly advantageous order to be able to realize as large a heat transfer as possible. A particularly large heat transfer can be achieved in particular by a countercurrent flow arrangement. A mixed arrangement of passages in the countercurrent flow and passages in the co-current flow or a pure co-current flow arrangement may also be advantageous.

In a further preferred exemplary embodiment, it can be provided that the refrigerant can flow through the channels forming the first flow channel in series and/or in parallel.

Advantages, particularly in respect of the heat transfer to be realized, can achieved through serial and/or parallel throughflow. Regions in which the refrigerant flows through the first flow channel in co-current flow or countercurrent flow with respect to the coolant can be produced.

Moreover, it may be advantageous if the coolant can flow through the channels forming the second flow channel in series and/or in parallel.

As in the case of the first flow channel, advantages can be achieved in the heat transfer to be obtained. Particularly through selective influencing of the throughflow direction of the first and the second flow channel, it is possible to achieve continuous countercurrent throughflow oz the refrigerant and of the coolant.

In addition, it is possible, by influencing the throughflow principle, to achieve an advantageous configuration of the fluid inlets and fluid outlets of the condenser.

It is furthermore preferable if the second flow channel allows flow in series, and a fluid inlet and a fluid outlet of the second flow channel are each arranged at the same end region of the plate stack.

Arranging the fluid inlet and the fluid outlet at the same end region of the plate stack enables the condenser to be constructed in a particularly compact manner.

In a particularly favorable refinement of the invention, it is furthermore envisaged that the first region or the second region of the first flow channel forms an internal heat exchanger of stacked plate design with a third flow channel, wherein a refrigerant can flow through the first flow channel and the third flow channel.

In one exemplary embodiment, the subcooling section of the second region is at least partially replaced by an internal heat exchanger. Here, the subcooling of the refrigerant is not accomplished by heat transfer between the refrigerant and the coolant.

By means of an internal heat exchanger, it is possible to intensify the cooling of the refrigerant in the condenser even further, leading to a higher capacity of the condenser overall. In an internal heat exchanger, refrigerant flows in two different flow channels which are oriented in such a manner that heat transfer is permitted between the fluids in the flow channels. The fluids advantageously flow here in a countercurrent flow with respect to one another.

In this case, the refrigerant flowing in the two flow channels is fed to the internal heat exchanger from different sections of the refrigerant circuit, thereby achieving as large a temperature difference between the fluids in the two flow channels as possible.

The arrangement of an internal heat exchanger after the second region, in which the subcooling takes place, lowers the temperature of the refrigerant even further. Overall, there is more intense subcooling of the refrigerant than through the sole use of a subcooling section or of an internal heat exchanger.

According to a further preferred exemplary embodiment, it can be provided that the third flow channel can be supplied with a refrigerant independently of the first flow channel or with a coolant independently of the second flow channel.

The independent supply of the third flow channel with either a coolant or a refrigerant is particularly advantageous since, in this way, a higher temperature difference can be achieved between the third flow channel and the first flow channel. This is true particularly if the third flow channel is supplied with an additionally cooled fluid.

It is furthermore preferable if the receiver is in fluid communication only with the second region of the first flow channel via a tube which leads through part of the plate stack and forms the fluid inlet into the receiver, and the fluid outlet of the receiver is formed by another tube, which through part of the plate stack and is in fluid communication only with the first region of the first flow channel.

By means of this connection of the receiver to the first and the second region of the first flow channel by means of tubes, the receiver can be positioned outside the plate stack and, at the same time, the simple construction of the plate stack can be achieved by using a large number of identical plate elements.

The tubes are passed here through the plate elements of those regions of the plate stack with which said tubes are not intended to be in fluid communication, and said tubes then open into those channels of the plate stack with which said tubes are in fluid communication.

In another preferred exemplary embodiment of the invention, the fluid inlet and/or the fluid outlet of the internal heat exchanger are/is formed by a tube.

The connection of the internal heat exchanger by means of one or two tubes is advantageous because it is possible in this way to retain the simplest structure of the plate stack of the condenser. The refrigerant which flows through the third flow channel of the internal heat exchanger can be passed in a controlled manner into a channel of the third flow channel and also in a controlled manner out of a channel of the third flow channel by means of a tube.

It is furthermore preferable if the first connection element is a tube and the second connection element is a flange or vice versa.

By designing the first and second connection element as described above, advantageous connection of the receiver to the condenser can be achieved. By means of a flange, it is possible, in particular, to achieve a very stable joint here, while the tube can be used for controlled feeding of the fluid into the condenser.

According to another alternative embodiment, provision can be made for the receiver to be designed to filter and/or dry the refrigerant.

In addition to the task of storage, it is also advantageous if the receiver performs the function of drying the refrigerant by suitable means for drying, and furthermore of filtering the refrigerant. In this way, excess moisture can be removed from the refrigerant and furthermore the latter can be freed from impurities. Integrating these functions in a single component is advantageous, particularly with regards the number of different components and the usage of installation space.

Advantageous developments of the present invention are described in the dependent claims and in the to description of the figures.

BRIEF DESCRIPTION OF THE DRAWINGS

The invention is explained in detail below by means of exemplary embodiments with reference to the drawings. In the drawings.

PREFERRED EMBODIMENT OF THE INVENTION

Figure 1:
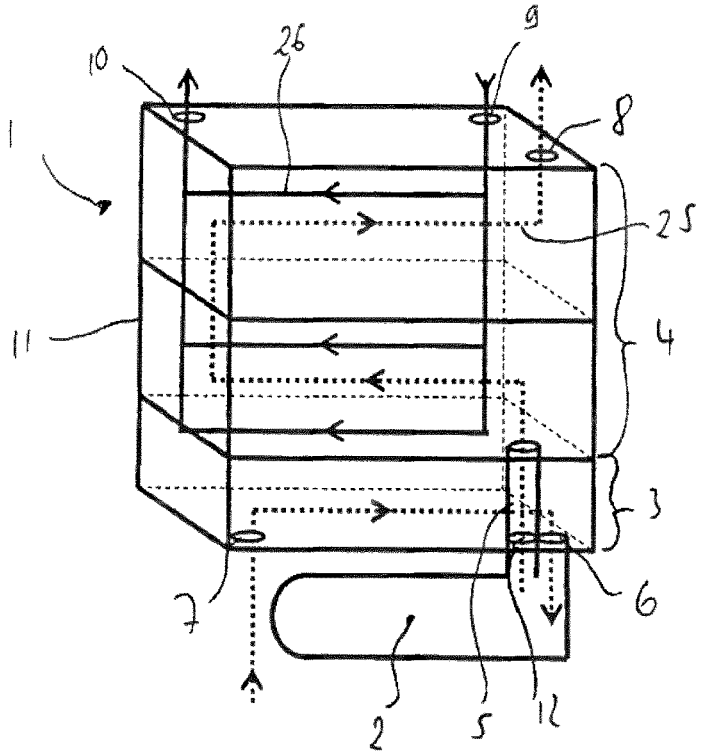
FIG. 1 shows a schematic view of a condenser, illustrating two flow channels, wherein the refrigerant flows through the condenser in series and the coolant flows through the condenser in parallel.

Different embodiments of a condenser 1, 1*a*, 70, 80 of stacked plate design are shown in the following FIGS. 1 to 8. These are condensers 1, 1*a*, 70, 80 for use in an air-conditioning system for motor vehicles. All the condensers 1, 1*a*, 70, 80 shown are formed by a multiplicity of plate elements, which form a plate stack 11, 11*a*, 73, 93 when stacked on top of each other.

The essential advantage of the construction as condenser 1, 1*a*, 70, 80 of stacked plate design is that the plate elements are largely identical and only the outer connection plates and individual deflecting or blocking plates which are installed in the stack and deflect or block the internal flow channels differ from the fundamentally identical shape of the plate elements. This allows low-cost and simple production.

In FIGS. 1 to 8, the condensers 1, 1*a*, 70, 80 are indicated only by a schematic diagram. The individual subregions of the condensers 1, 1*a*, 70, 80, such as the desuperheating region 3, 72, 81 or the subcooling region 4, 71, 82 and the region of an internal heat exchanger 88, are represented in the figures only as cuboidal elements.

In reality, each of these cuboidal elements consists of a multiplicity of plate elements. These plate elements are stacked on top of each other and, through a special arrangement of openings, which can have rims, form a multiplicity of individual channels which, by virtue of the configuration of the individual plate elements, are combined into flow channels which carry either coolant or refrigerant.

In this case, the flow channels of the coolant and the flow channels of the refrigerant are arranged adjacent to one another. In simple embodiments, it may be provided that channels for the refrigerant and channels for the coolant are arranged in a uniformly distributed alternating sequence. It is likewise conceivable to select a distribution of refrigerant channels to coolant channels which differs from the uniform distribution. It is also possible to provide for implementation of the frequency of alternation between coolant channels and refrigerant channels to differ from a ratio of 1:1.

The flow channels of the coolant and of the refrigerant are likewise indicated only schematically in FIGS. 1 to 8. In FIGS. 1 to 8, each of the cuboidal elements is traversed only once by a refrigerant channel, and a coolant channel. This illustration is intended to clarify only the principle of flow through the individual condensers 1, 1*a*, 70, 80 and has no delimiting or restrictive effect.

The flow channels of the refrigerant 25, 25*a*, 60, 87 are each indicated by a dotted line. The flow channels of the coolant 26, 26*a*, 32, 42, 52, 85 are each indicated by a continuous line.

The flow directions of the refrigerant, and of the coolant which are shown in FIGS. 1 to 8 each represent only an example and can equally well be implemented opposite to the directions shown in FIGS. 1 to 8.

FIG. 1 shows a condenser which consists of desuperheating region and a subcooling region 4. The desuperheating region 3 is used to desuperheat a refrigerant and to condense the refrigerant from the vaporous phase thereof into a liquid phase. For the purpose of desuperheating, the refrigerant is made to undergo heat exchange with a coolant, which likewise flows through the desuperheating region 3. A subcooling region 4 is upwardly connected to the desuperheating region 3. In this subcooling region 4, the fully liquid refrigerant is cooled down further under the condensation temperature by a further heat exchange with a coolant.

Arranged underneath the condenser 1 is a receiver 2, through which the refrigerant flows. The function of the receiver 2 is to store, filter and dry the refrigerant. Introducing a receiver 2 into the refrigerant circuit makes it possible to compensate for the volume in the refrigerant circuit since the receiver 2 represents compensating reservoir, thereby making it possible to compensate for fluctuations in the volume of refrigerant in the refrigerant circuit.

The fluid outlet 12 of the receiver 2 has a tube 5, which is passed through the desuperheating region 3 and is in fluid communication with the flow channel 25 of the refrigerant in the subcooling region 4. The fluid inlet 6 of the receiver 2 is, in turn, in fluid communication with the flow channel 25 of the refrigerant in the desuperheating region 3.

After flowing through the receiver 2, all of the refrigerant is passed into the subcooling region 4. The receiver 2 thus represents the point of fluid transfer from the desuperheating region 3 to the subcooling region 4.

Openings 8, 9, 10 are arranged at the upper end region of the plate stack 11 of the condenser 1. Depending on the configuration of the internal flow channels, said openings can form fluid inlets and fluid outlets. An opening 7 is likewise shown at the lower end of the plate stack 11, and said opening can likewise be a fluid inlet or a fluid outlet, depending on the configuration of the internal flow channels.

Flow channels 25, 26 for a refrigerant and a coolant are illustrated in the interior of the condenser 1. The refrigerant flows through the fluid inlet 7, which is arranged at the lower end region of the plate stack 11, into the desuperheating region 3 of the condenser 1. The refrigerant flows there through the channels which are formed by the plate elements and which belong to the flow channel 25 of the refrigerant.

After flowing through the desuperheating region 3, the refrigerant flows via the fluid inlet 6 into the receiver 2. The refrigerant flows there through the receiver 2 for the purpose of storage, filtration and drying, and then flows via the fluid outlet 12 through the tube 5 into the subcooling region 1 of the condenser 1. After flowing through the subcooling region 4, the refrigerant flows out of the condenser 1 through the fluid outlet 8 at the upper end region.

The coolant flows into the subcooling region 4 through the fluid inlet 9 at the upper end region of the condenser 1. In contrast to the refrigerant, which flows through the individual, channels in series, the coolant flows through the individual channels of the subcooling region 4 and of the desuperheating region 3 in parallel. For this purpose, the coolant flows from the top down through the plate stack 11, through internal openings, and is distributed over the width of the condenser 1. After the coolant has flowed over the entire width of the condenser 1, the coolant then flows from the bottom up through a plurality of openings in the plate elements, through the fluid outlet 10 and out of the condenser 1. The openings through which the coolant flows downward in the condenser 1 and the openings through which the coolant flows upward in the condenser 1 are each aligned with one another here.

By means of the construction, regions through which the flow passes in a countercurrent flow and regions through which the flow passes in a co-current flow are produced in the condenser 1.

Figure 2:
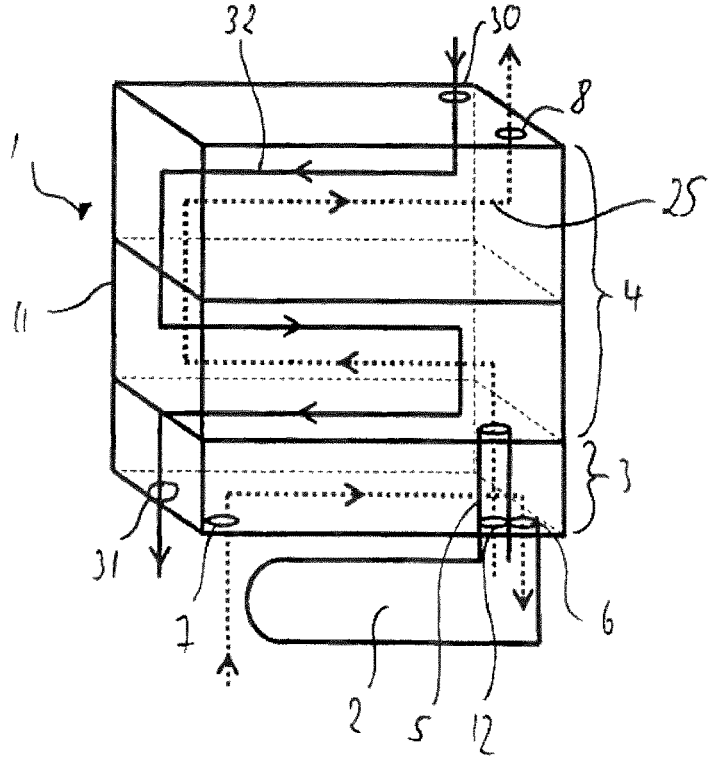
FIG. 2 shows a schematic view of a condenser in accordance with FIG. 1, wherein, the refrigerant flows through the condenser in series and the coolant flows through the condenser in series.

FIG. 2 shows a construction similar to that already illustrated in FIG. 1. The flow channel 25 of the refrigerant is arranged through the condenser 1 of FIG. 2 in a manner similar FIG. 1. As a departure from FIG. 1, the coolant in FIG. 2 now no longer flows through the channels of the condenser 1 in a parallel arrangement but, like the refrigerant, flows through the condenser 1 in series.

For this purpose, the coolant flows through the fluid inlet 30 at the upper region of the condenser 1 into the subcooling region 4. The coolant is distributed there over the width of the condenser 1 and flows downward via an internal opening into a further channel of the subcooling region 4. The coolant is again distributed there over the entire width before flowing downward through a further opening into the desuperheatng region 3. Finally, after renewed distribution over the width of the condenser 1, the coolant flows out of the condenser 1 through the fluid outlet 31 at the lower end region.

In FIG. 2, the flow channel 32 of the coolant, like the flow channel 25 of the refrigerant, passes in a series through the individual channels in the interior of the condenser 1. Through the illustration shown in FIG. 2, the refrigerant flow is in a countercurrent configuration with respect to the coolant flow throughout the condenser 1.

Figure 3:
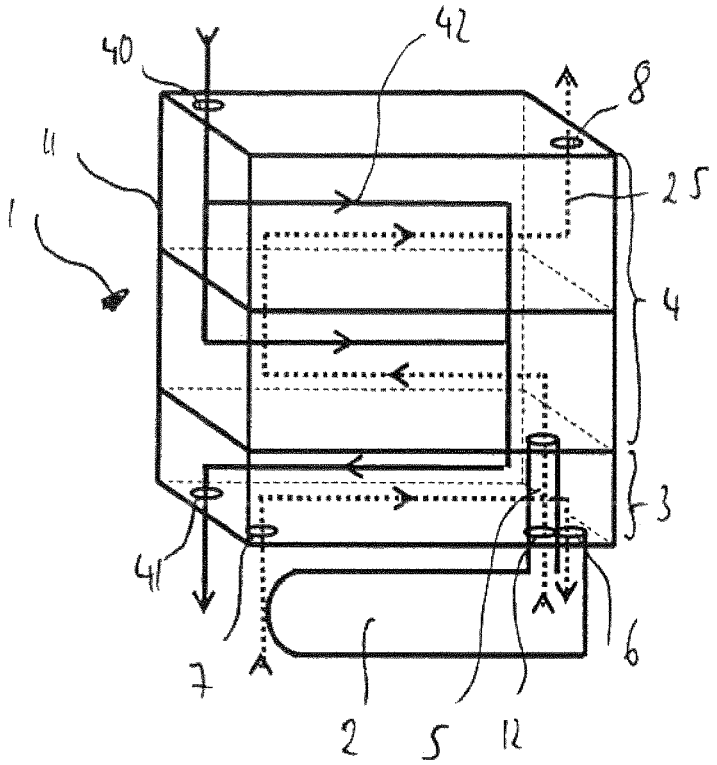
FIG. 3 shows a schematic view of a condenser in accordance with FIGS. 1 and 2, wherein the refrigerant flows through the condenser in series and the coolant flows through the condenser both in series and in parallel.

FIG. 3 shows a condenser 1 similar to FIGS. 1 and 2. The refrigerant flow channel 25 is embodied in a manner similar to FIGS. 1 and 2. As a departure from FIGS. 1 and 2, the flow channel 42 of the coolant is now arranged within the condenser 1 in such a way that there are both regions in which the flow passes through in parallel and regions in which the flow passes through in series.

For this purpose, the coolant flows through the fluid inlet 40 into the subcooling region 4 of the condenser 1. The coolant is distributed there both over the width of the condenser 1 and downward through internal openings within the subcooling region 4. The flow passes through the subcooling region 4 entirely in parallel. The coolant then flows out of the subcooling region 4 through openings into the desuperheating region 3. From there, the coolant flows out of the condenser 1 via the fluid outlet 41. The flow passes through the desuperheating region 3 only in series.

In this way, some of the coolant flows through the condenser 1 in parallel and some of it flows through the condenser 1 in series. There are thus regions in which the coolant flows in a countercurrent flow with respect to the refrigerant and regions in which the coolant flows in co-current flow with respect to the refrigerant.

Figure 4:
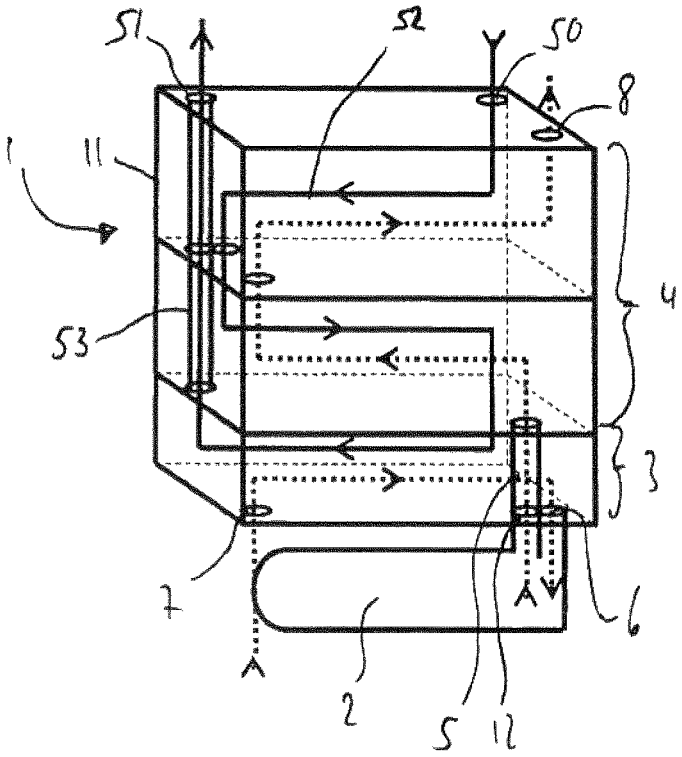
FIG. 4 shows a schematic view of a condenser in accordance with FIGS. 1 to 3, wherein the refrigerant flows through the condenser in series and the coolant flows through the condenser in series, wherein the coolant is passed through the condenser by means of a tube.

FIG. 4 likewise shows a condenser 1 similar to the embodiments of FIGS. 1 to 3. The flow channel 25 of the refrigerant is unchanged relative to FIGS. 1 to 3. As a departure from the previous figures, the coolant is now passed through the condenser 1 entirely in series. The coolant flows here through the fluid inlet 50 into the condenser 1 and out of the condenser 1 via the fluid outlet 51. Fluid inlet 50 and fluid outlet 51 are located here at a common end region of the condenser 1.

The coolant flows here into the subcooling region 4 where it is distributed over the width of the condenser 1. The coolant then flows through openings into a part of the subcooling region 4 that is located therebelow and is likewise distributed again over the entire width of the condenser. The coolant subsequently passes via openings in the interior of the condenser 1 into the desuperheating region 3. After being distributed over the width of the condenser 1, the coolant flows through the tube 53 and out of the condenser 1 via the fluid outlet 51.

The tube 53 is in fluid communication here with one of the channels of the second flow channel 52. By means of the tube 53, the coolant can be discharged from the desuperheating region 3 through the entire subcooling region 4 and out of the condenser 1 without the coolant being able to be mixed with the refrigerant.

The coolant thus flows entirely in series through the regions 3 and 4 of the condenser 1. The coolant which flows in the flow channel 52 thus flows in a countercurrent flow with respect to the refrigerant in the flow channel 25 at all times.

Figure 5:
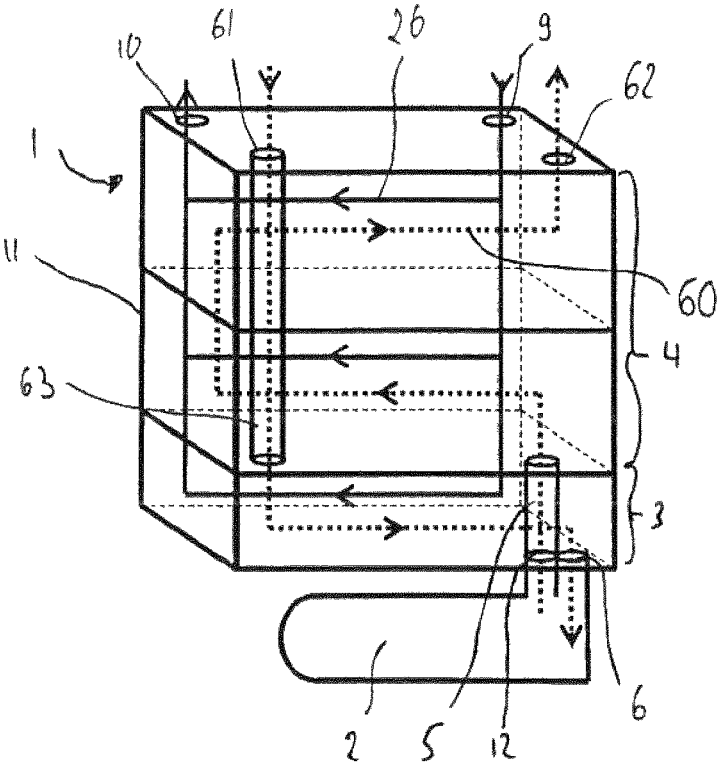
FIG. 5 shows a schematic view of a condenser in accordance with FIGS. 1 to 4, wherein the refrigerant flows through the condenser in series and is introduced from above into the condenser by a tube, wherein the coolant flows through the condenser in parallel.

FIG. 5 shows a condenser 1. The course and the orientation of the coolant channel 26 correspond to the course already shown in FIG. 1. The course of the refrigerant channel 60 likewise substantially corresponds to the course of the flow channel 25 from FIG. 1.

In a departure from the fluid inlet 7 arranged at the lower end region of the condenser 1, the fluid inlet 61, like the fluid outlet 62, is now arranged at the upper end region of the condenser 1. In order to permit such a routing of the flow, the condenser 1 has a tube 63 which connects a channel of the desuperheating region 3 to the fluid inlet 61.

The refrigerant therefore flows through the tube 63 into the desuperheating region 3 and from there, as already described in the previous figures, in series through the individual channels of the first flow channel in the desuperheating region 3 and in the subcooling region 4.

Figure 6:
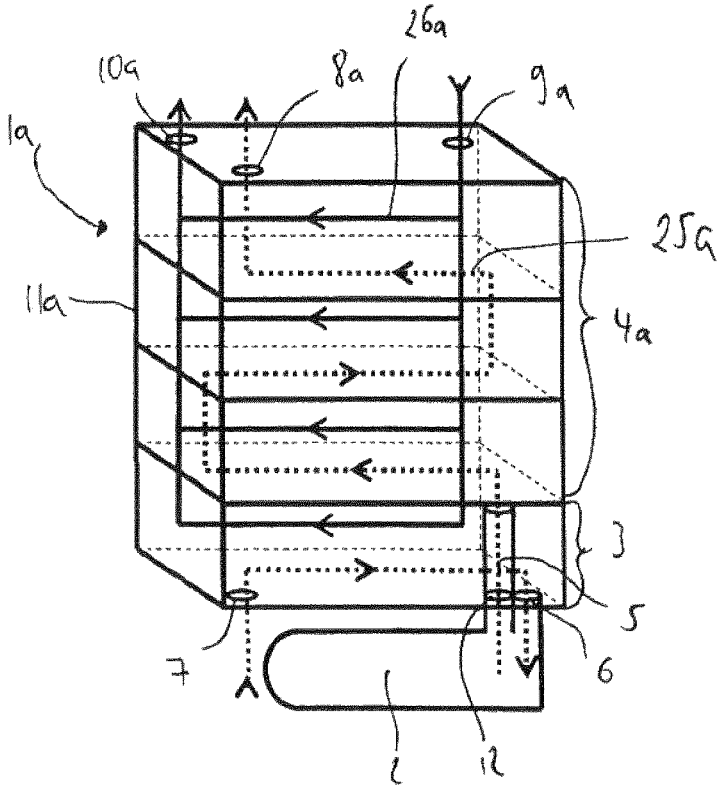
FIG. 6 shows a schematic view of a condenser, wherein the subcooling region is enlarged in comparison to FIGS. 1 to 5.

FIG. 6 shows a further view of condenser 1*a*, with the fluid inlet 9*a* and fluid outlet 10*a*, as in the previous FIGS. 1 to 5. In addition, the condenser 1*a* now has a further subcooling section. The subcooling region 4*a* is therefore larger and has more channels than the subcooling region 4 of the previous FIGS. 1 to 5.

The routing of the flow through the first flow channel 25*a*, through which the refrigerant flows, is entirely in series. The routing of the flow through the second or channel 26*a* is entirely in parallel. Regions of the condenser 1*a* through which the flow passes in a countercurrent flow and regions of the condenser 1*a* through which the flow passes in a co-current flow are thereby produced.

By means of the additional deflection of the refrigerant in the third subcooling section, the positioning of the fluid outlet 8*a* is changed in comparison to the arrangement of the fluid outlet 8 in FIG. 1. In contrast to FIG. 1, the fluid outlet 8*a* is arranged on the opposite side of the condenser 1*a*. The fluid inlet 7 and the fluid outlet 8*a* are in mutual alignment.

By changing the number of channels, the position and positioning of the fluid inlet 7 and of the fluid outlet 8*a* can therefore also be affected.

The number of channels which are associated with the first flow channel 25*a* and the second flow channel 26*a* depends primarily on the number of plate elements used in the plate stack 11*a*. A higher number or a lower number can always be provided. The exemplary embodiments illustrated here do not have any limiting character in this respect.

Figure 7:
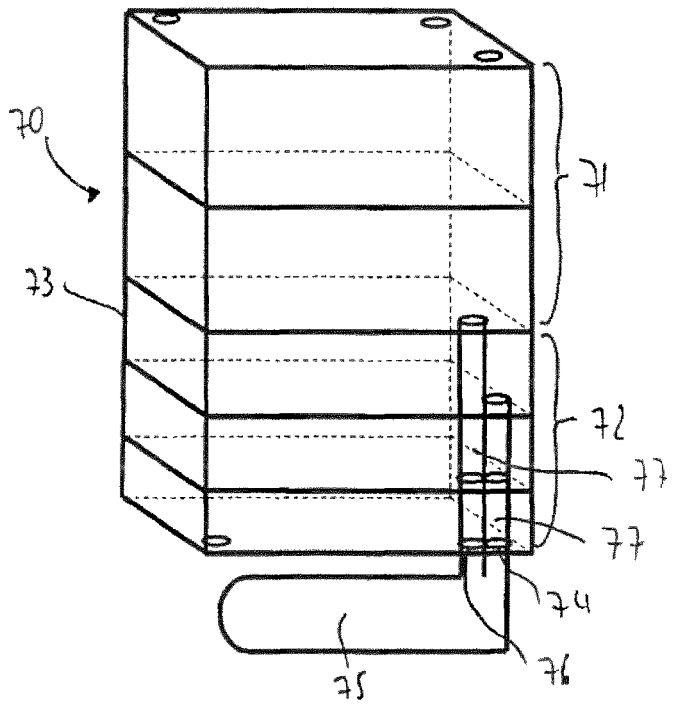
FIG. 7 shows a schematic view of a condenser, wherein the desuperheating region is enlarged in comparison to FIGS. 1 to 6.

FIG. 7 shows an exemplary embodiment of a condenser 70, wherein the subcooling region 71 is illustrated by two cuboidal elements. By contrast, in a departure from the embodiments of FIGS. 1 to 6, the desuperheating region 72 is illustrated by three cuboidal elements. An increase or reduction in the number of cuboidal elements can be achieved by changing the number of plate elements in the plate stack 73.

At the fluid inlet 74 of the receiver 75 and the fluid outlet 76, FIG. 7 illustrates tubes 77 of differing length which each produce a fluidic connection to the channels of the first flow channel.

Both serial throughflows and parallel throughflows can achieved in the desuperheating region 72 and in the subcooling region 71. This essentially depends on the connection of the channels to one another.

Figure 8:
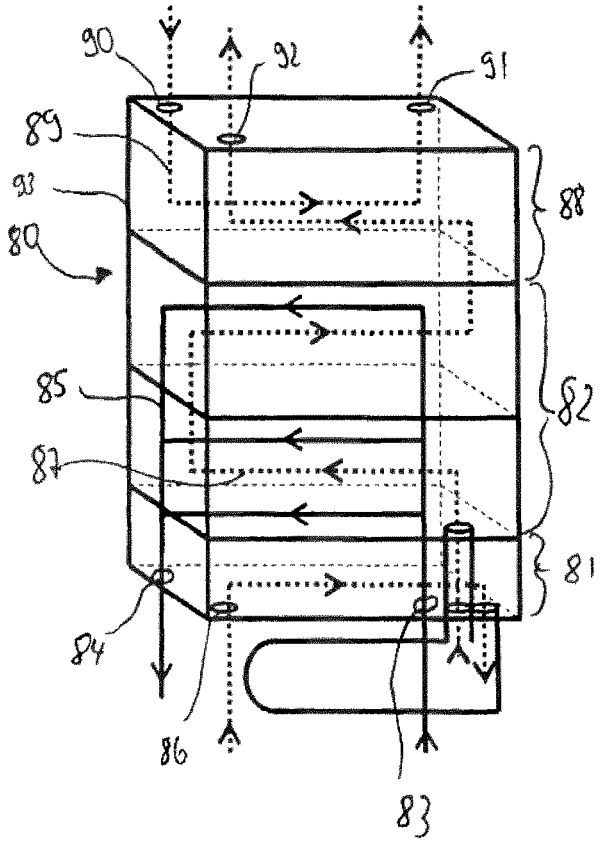
FIG. 8 shows a schematic view of a condenser, wherein an internal heat exchanger is provided in addition to the desuperheating region and the subcooling region.

FIG. 8 shows a condenser 80 with a desuperheating region 81 at the lower end region of the condenser 80 and two subcooling regions 82 located thereabove. The condenser 80 here is substantially formed by the plate stack 93.

The coolant flows both through the subcooling region 82 and through the desuperheating region 81 in parallel. Both the fluid inlet 83 and the fluid outlet 84 of the second flow channel 8 are arranged at the lower end region of the condenser 80.

Furthermore, the fluid inlet 86 of the first flow channel 87 is arranged at the lower end region. The refrigerant flows through, the desuperheating region 81 and the subcooling region 82 in series in a manner similar to the illustrations of FIGS. 1 to 4.

A further cuboidal element is illustrated above the subcooling region 82. Said cuboidal element forms an internal heat exchanger 88.

The internal heat exchanger 88 has a third flow channel 89. At the same time, the refrigerant is also led out of the flow channel 87 into the internal heat exchanger 88. A heat transfer between the fluid of the third flow channel 89 and the refrigerant of the first flow channel 87 can thus take place in the internal heat exchanger 88.

Either refrigerant or a coolant can flow here through the third flow channel 89. As also in the remaining regions of the condensers shown, the flow can also pass through the internal heat exchanger 88 in a co-current flow and/or in a countercurrent flow. By flowing therethrough in a countercurrent flow, a higher heat transfer between the two fluid flows can be achieved.

Both the fluid inlet 90 and the fluid outlet 91 of the third flow channel 89 are arranged at the upper end region of the condenser 80. Also arranged there is the fluid outlet 92 of the first flow channel 87.

The positions of the fluid inlets and fluid outlets shown in FIGS. 1 to 8 are in each case by way of example. Orientations that differ therefrom, e.g. laterally on the condenser, can be provided, as can the arrangement of a fluid inlet or fluid outlet in a central region of the condensers.

The condensers 1, 1*a*, 70, 80 can furthermore be produced selectively from a combination of a desuperheating region 3, 72, 81, a subcooling region 4, 71, 82 and an internal heat exchanger 88. Here, optimum configurations which all have a simple construction consisting of individual plate elements and are thus very flexible in their construction can be produced, depending on the intended use.

The tubes 5, 53, 63, 77 shown in FIGS. 1 to 8 can likewise be produced at low cost and, in the simplest case, are inserted into the plate stacks 11, 11*a*, 73, 92, passing through internal openings in the plate elements. It is advantageous if this takes place at an early stage of the production process, allowing the plate elements to be brazed to the individual tubes 5, 53, 63, 77 in one operation. In this connection, the tubes 5, 53, 63, 77 are brazed in particular to the openings, which have rims.

Figure 9:
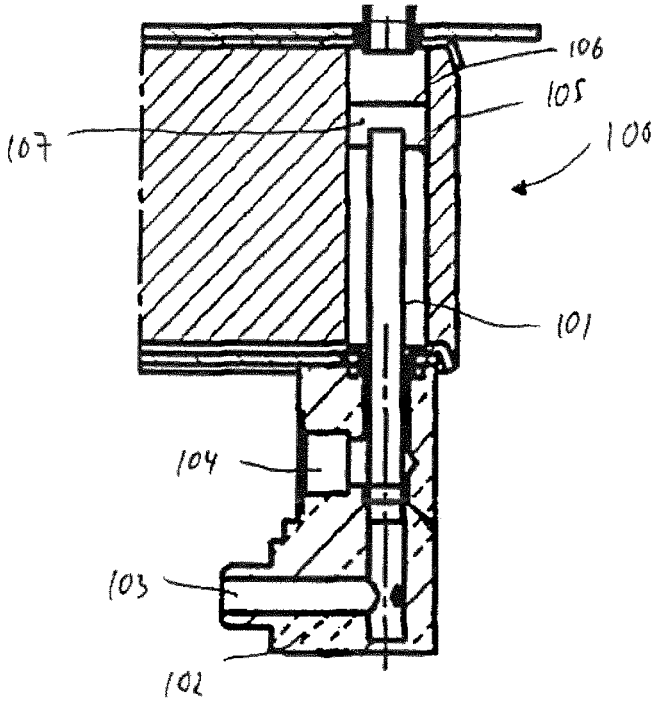
FIG. 9 shows a sectional view through the connection region at which the receiver is connected to the condenser.

FIG. 9 shows sectional view of a condenser 100 according to the invention. FIG. 9 in particular shows the connection region at which a receiver (not shown) is connected to the plate stack of the condenser 100 is a flange 102. The flange 102 has an inlet 104 and an outlet 103. Via the latter, a fluid can pass out of the condenser 100 into a receiver and pass back from the receiver into the condenser 100.

The outlet 103 opens here into a tube 101 which itself opens into a flow channel 107. The flow channel 107 here is one of the channels which is produced between, for example, two stacked plate elements 105 and 106. A detailed view of the connection of the tube 101 to the plate element 105 is shown in the following FIG. 10.

A fluid can flow from the inlet 104 around the tube 101 and can continue upward into a region below the plate element 105. The precise configuration of the channels is likewise shown in FIG. 10.

Figure 10:
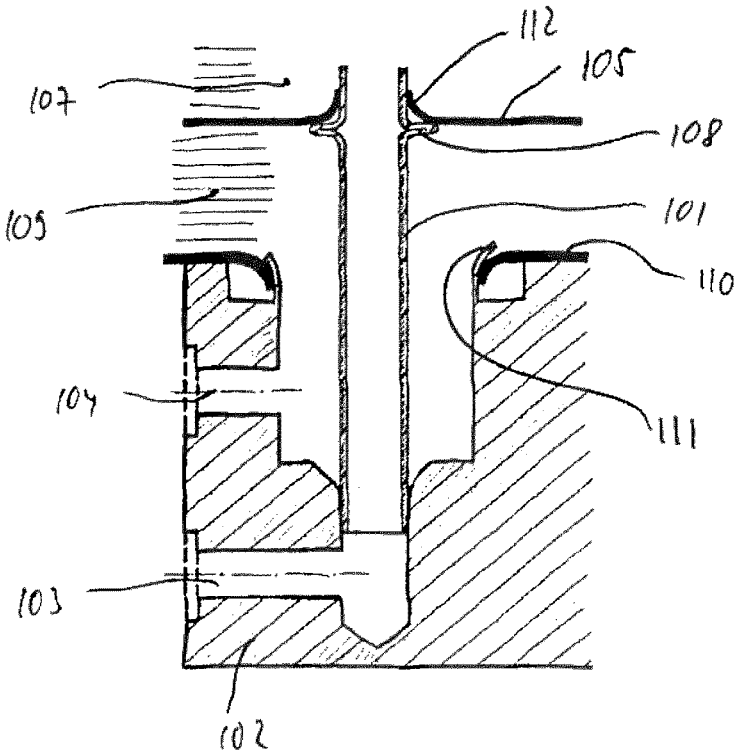
FIG. 10 shows a detailed sectional view of the connection region according to FIG. 9.

FIG. 10 shows a detailed view of the arrangement of the tube 101, as has already been shown in FIG. 9. It can seen in FIG. 10 in particular how the tube 101 is inserted into an outlet 103 of the flange 102.

The outlet 103 is formed here by a horizontally running bore within the flange 102. The tube 101 is inserted via a bore opening the bore of the outlet 103 vertically from above. The inlet 104 likewise opens into a bore within the flange 102.

The bore which is of larger diameter and into which the inlet 104 opens is oriented concentrically with respect to the bore which opens into the outlet 103. The fluid which flows along the inlet 104 therefore flows around the tube 101, while the fluid which flows to the outlet 103 flows through said tube. There is no fluid communication of the fluid flow outside the tube 101 with the fluid flow within the tube 101.

The tube 101 has an at least partially encircling flange 108 in the upper end region thereof. Said flange 108 is produced in FIG. 10 by compression and a resulting doubling of the material of the tube 101. The flange 108 bears against the lower side of the plate element 105.

The plate element 105 furthermore has a rim 112 which is formed around the opening through which the tube 101 is inserted. A flow channel 107 is formed above the plate element 105, and a flow channel 109 is formed below the plate element 105.

In differing configurations, pluralities of flow channels can also be provided above and below the plate element 105. The illustration in FIG. 10 is by way of example.

The tube 101 is primarily connected to the plate element 105 in particular in the region of the rim 112. This can be achieved, for example, by an adhesive bonding operation or a brazing operation.

The flange 102 is fastened to a lower plate element 110 by means of connecting elements 111. The plate element 110 has an opening which has a downwardly directed rim. The connecting means 111 are formed in FIG. 10 by means of material extensions of the flange 102, which reach behind the rim of the plate element 110 and thereby prevent the flange 102 from slipping out of the opening in the plate element 110. It is likewise possible for, for example, an adhesive joint or a brazed joint to be provided between the flange 102 and the plate element 110 for the permanent connection.

Figure 11:
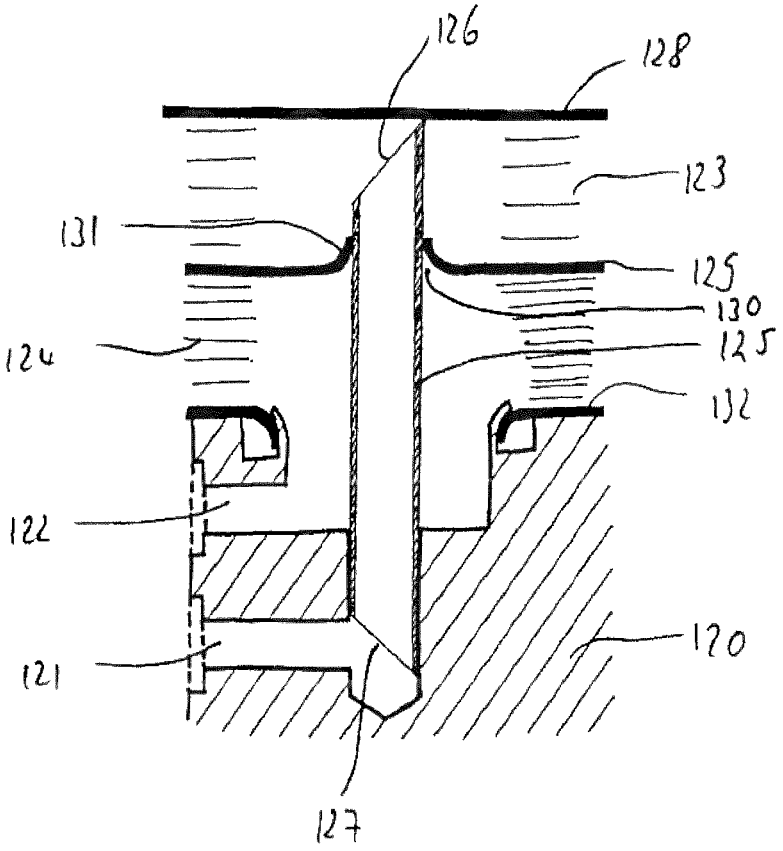
FIG. 11 shows a sectional view through the connection region, wherein the tube has two beveled end regions.

FIG. 11 likewise shows a connection of a flange 120 to a condenser formed from a plurality of plate elements 128, 129 and 132. The construction of the flange 120 substantially corresponds here to the flange 102 already shown. The flange 120 is likewise again connected to the condenser at a rim of an opening of the lower plate element 132.

The tube 125 has a bevel both at the upper end region 126 and the lower end region 127. Said bevel is achieved by a cut which has been produced in a plane located at a predeterminable angle with respect to the center axis of the tube 125. By means of the beveled end regions 126, 127, the tube has an arrow configuration at both ends.

In the upper end region, the tube 125 is supported by the point on the plate element 128 located at the top. The plate element 128 here forms a deflecting plate for the flow channel 123 shown. The lower plate element 129 forms a separating plate between the flow channel 123 and 124.

The tube 125 thus represents a fluid communication between the outlet 121 and the flow channel 123, while the fluid which flows along the inlet 122 flows around the said tube. Owing to the arrow configuration, the tube 125 can both bear at an end region 126 against a surface and can thereby position the tube 125 and can also form a suitable transfer surface for a fluid from the tube 125 into the flow channel or from a flow channel into the tube 125.

The tube 125 is connected to the plate element 129 likewise at a rim 131, which is formed around the opening 130 in the plate element 129.

In the lower end region, the tube 125 likewise has a beveled end region 127. The tube can be supported in the flange 120 via said beveled end region and at the same time can represent a suitable flow cross section for the transfer of fluid from the outlet 121 into the tube 125.

Figure 12:
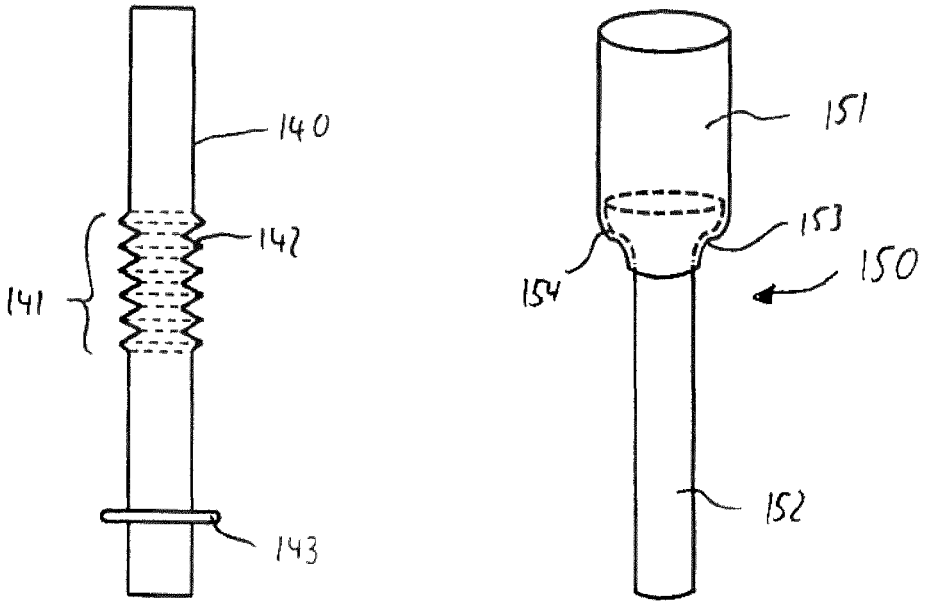
FIG. 12 shows two different configurations of a tube according to the invention, wherein a tube with a flexible region is illustrated in the left part of the figure and a multi-part tube is illustrated in the right part of the figure.

FIG. 12 shows two exemplary embodiments of a tube 140 and 150. The tube 140 is illustrated in the left part of FIG. 12. Said tube has, in the lower region, an encircling flange 143 with which said tube can be supported in relation to plate elements or a flange.

The tube 140 has a flexible region 141 in the center. Said flexible region 141 is produced by a concertina-like configuration of the tube 140. The concertina-like region here has a plurality of material folds 142. In this way, the tube 140 can particularly preferably absorb both compressions and extensions in particular in the axial direction. In the event of a compression, the material folds 142 are moved toward one another, and are pulled apart from one another in the event of an extension.

Depending on the selected, material and selected dimensioning of the flexible region 141, the possible length compensation which can be achieved via the tube 140 can turn out to differ in size.

In particular during the brazing process of a condenser, "settling" occurs within the condenser, as a result of which the overall length of the condenser is shortened. By means of the provision of a flexible region 141 in a tube 140, said resulting change in length can be absorbed in such a manner that the production, of mechanical or thermal stresses within the condenser is avoided.

The right part of FIG. 12 shows an alternative configuration of a tube 150. The tube 150 is formed by a first tube section 151 and a second tube section 152. The tube sections 151, 152 are inserted here one inside the other in such a manner that they are movable relative to each other. At the same time, the tube sections 151, 152 are fluid tight with respect to each other in such a manner that no inadvertent mixing between a fluid flowing around the tube 150 and a fluid flowing through the tube 150 arises.

The second tube section 152 has a cross section 154 widening in a funnel-shaped manner upward in the axial direction. The first tube section 151 has a cross section 153, tapering in a funnel-shaped manner, as viewed downward in the axial direction. At the same time, the inside diameter of the first tube section 151 is selected in such a manner that it is larger than the outside diameter of the second tube section 152. The two tube sections 151, 152 can thereby be moved relative to each other. By means of the configuration of the funnel-shaped regions of the tube section 151 and of the tube section 152, a stop is realized at the same time, said stop defining a limit of the maximum possible movement of the tube sections 151, 152 relative to each other.

The configuration of the tubes 140 and 150 in FIG. 12 is by way of example. In an advantageous manner, metallic materials can be used for the tube 140 or 150, but more flexible materials, such as plastics or elastomers, can also used. The embodiments of FIG. 12 do not have any limiting character in respect of the configuration of the tube.

The illustrations of a condenser that are shown FIGS. 1 to 8 likewise have an exemplary character and do not have any limiting effect. They can be combined with one another and clarify the inventive concept.

The illustration of the connection of a tube or a flange to a condenser that is shown in FIGS. 9 to 12 is likewise by way of example. In particular, the various tubes shown in FIGS. 9 to 12 can be combined as desired with the various condensers of FIGS. 1 to 8. The tubes shown in FIGS. 9 to 12 can be used here both for connecting the receivers and for connecting channels to fluid inlets and fluid outlets in the remaining region of the condensers.

The invention claimed is:

1. A condenser of stacked plate design comprising:

a first flow channel for a refrigerant, a second flow channel for a coolant, a receiver for storing the refrigerant, and a plurality of stacked plate elements wherein the stacked plate elements form a plurality of channels adjacent to each other arranged between the plate elements, wherein a first number of the plurality of channels is associated with the first flow channel and a second number of the plurality of channels is associated with the second flow channel, wherein the first flow channel has a first region for desuperheating and condensing the vaporous refrigerant and a second region for subcooling the condensed refrigerant, wherein a refrigerant transfer from the first region to the second region in the first flow channel leads through the receiver, wherein the receiver is in fluid communication with the first region through a first connection element which forms a first fluid connection of the receiver, wherein the receiver is in fluid communication with the second region through a second connection element which forms a second fluid connection of the receiver, wherein the first connection element or the second connection element is formed by a tube which passes through a number of plate elements through openings in the plate elements, wherein the first connection element and the second connection element are arranged at least partially within a single flange, wherein an inlet of the flange is connected to the first connection element and an outlet of the flange is connected to the second connection element, wherein the receiver is connected to the plurality of stacked plate elements through the flange.

2. The condenser as claimed in claim 1, wherein the tube is fluidically connected to the second region at a first end having a first opening, wherein the tube is fluidically connected to the receiver at a second end having a second opening, wherein the tube passes through at least a portion of the first region but is fluidically isolated from the first region.

3. The condenser as claimed in claim 1, wherein at least one of the tubes has a tapered portion and/or a step and/or an at least partially encircling flange and/or an expanded portion via which said tube is supportable on one of the plate elements and is fixable in the condenser.

4. The condenser as claimed in claim 1, wherein at least one of the plate elements is designed as a separating plate and/or one of the plate elements is designed as a deflecting plate.

5. The condenser as claimed in claim 4, wherein the tube is supported in the condenser on a deflecting plate.

6. The condenser as claimed in claim 1, wherein the tube has radial and/or axial openings.

7. The condenser as claimed in claim 1, wherein the tube is supported on one of outer plate elements of the second region.

8. The condenser as claimed in claim 1, wherein a second tube is provided at a fluid inlet and/or at a fluid outlet of a subsection of the first flow channel, said second tube being in fluid communication with another subsection of the first flow channel.

9. The condenser as claimed in claim 1, wherein a third tube is provided at a fluid inlet and/or at a fluid outlet of a subsection of the second flow channel, said third tube being in fluid communication with another subsection of the second flow channel.

10. The condenser as claimed in claim 1, wherein the at least one tube is passed through the openings in the plate elements and is brazed to at least a subset of the plate elements, in particular to rims.

11. The condenser as claimed in claim 1, wherein at least one of the tubes is beveled at upper or lower end region or at both end regions of the tube.

12. The condenser as claimed in claim 1, wherein at least one of the tubes has a flexible region, wherein the tube is compressible and/or extendable in an axial direction by means of the flexible region.

13. The condenser as claimed in claim 12, wherein the flexible region is formed by a concertina-like configuration of the tube.

14. The condenser as claimed in claim 12, wherein the flexible region is formed from an elastic material, wherein a compression or extension of the tube in an axial direction and/or in the radial direction is reversible.

15. The condenser as claimed in claim 1, wherein at least one of the tubes is formed from a plurality of tube sections, wherein the tube sections are connected in a fluid-tight manner to one another.

16. The condenser as claimed in claim 1, wherein a first tube section tapers in a funnel-shaped manner in an axial direction and a second tube section widens in a funnel-shaped manner in the axial direction, wherein the two tube sections are inserted one inside the other in such a manner that the relative movement between the second tube section and the first tube section is limited by the widening region striking against the tapering region.

17. The condenser as claimed in claim 1, wherein the tube is accommodated in a connection element and is connected in a fluid-tight manner thereto.

18. The condenser as claimed in claim 1, wherein the second region has a plurality of flow routes through which the refrigerant can flow, wherein the flow routes are each formed by individual channels of the first flow channel and/or are formed by subregions of individual channels of the first flow channel.

19. The condenser as claimed in claim 1, wherein the second region has a plurality of channels, wherein at least individual channels of the second region are in thermal contact with the second flow channel, wherein the coolant and the refrigerant are flowable in co-current flow and/or in countercurrent flow to each other through the channels of the second region and through the second flow channel.

* * * * *